US011145449B2

(12) United States Patent
Uekusa et al.

(10) Patent No.: US 11,145,449 B2
(45) Date of Patent: Oct. 12, 2021

(54) REACTOR

(71) Applicant: TAMURA CORPORATION, Tokyo (JP)

(72) Inventors: Yasuhiro Uekusa, Sakado (JP); Takahiro Yamada, Sakado (JP)

(73) Assignee: TAMURA CORPORATION, Tokyo (JP)

( * ) Notice: Subject to any disclaimer, the term of this patent is extended or adjusted under 35 U.S.C. 154(b) by 427 days.

(21) Appl. No.: 16/165,239

(22) Filed: Oct. 19, 2018

(65) Prior Publication Data

US 2019/0131053 A1 May 2, 2019

(30) Foreign Application Priority Data

Oct. 27, 2017 (JP) ..... JP2017-208155

(51) Int. Cl.

| | |
|---|---|
| ***H01F 27/02*** | (2006.01) |
| ***H01F 27/36*** | (2006.01) |
| ***H01F 27/08*** | (2006.01) |
| ***H01F 27/29*** | (2006.01) |
| ***H01F 27/34*** | (2006.01) |
| ***H01F 27/24*** | (2006.01) |
| ***H01F 27/28*** | (2006.01) |
| ***H01F 27/04*** | (2006.01) |
| ***H01F 37/00*** | (2006.01) |

(52) U.S. Cl.

CPC ..... *H01F 27/08* (2013.01); *H01F 27/02* (2013.01); *H01F 27/04* (2013.01); *H01F 27/24* (2013.01); *H01F 27/2828* (2013.01); *H01F 27/29* (2013.01); *H01F 27/346* (2013.01); *H01F 27/36* (2013.01); *H01F 27/361* (2020.08); *H01F 27/363* (2020.08); *H01F 27/366* (2020.08); *H01F 37/00* (2013.01)

(58) Field of Classification Search

CPC ..... H01F 27/08; H01F 27/361; H01F 27/363; H01F 27/366; H01F 27/2828; H01F 27/04; H01F 37/00; H01F 27/36; H01F 27/29; H01F 27/02; H01F 27/346; H01F 27/24

See application file for complete search history.

(56) References Cited

U.S. PATENT DOCUMENTS 6,377,153 B1 * 4/2002 Yamanaka ..... H01F 30/16 336/84 R
2011/0094090 A1 * 4/2011 Shang ..... H01F 37/00 29/602.1

FOREIGN PATENT DOCUMENTS

JP 5685806 A 7/1981
JP 4107817 U 9/1992
(Continued)

OTHER PUBLICATIONS

Notice of Reasons for Refusal dated Aug. 10, 2021 corresponding to Japanese application No. 2017-208155.

*Primary Examiner* — Tuyen T Nguyen
(74) *Attorney, Agent, or Firm* — Nath, Goldberg & Meyer; Jerald L. Meyer

(57) ABSTRACT

A reactor includes a reactor main body that includes a core and a coil attached to the core, a casing that houses therein the reactor main body and has a portion where an opening is formed, a terminal stage that supports the portion of a conductor electrically connected to the coil, and a shielding member that is integrally formed with the terminal stage and suppresses the leakage of magnetic fluxes from the reactor main body while maintaining the opening opened.

14 Claims, 13 Drawing Sheets

(56) References Cited

FOREIGN PATENT DOCUMENTS

| | | | |
|---|---|---|---|
| JP | 543445 | Y2 | 11/1993 |
| JP | H11-354339 | A | 12/1999 |
| JP | 2016184990 | A | 10/2016 |

* cited by examiner

100
Y
X
B
15a
21c
21d
31a
43a
631
13a
611
31
61
43b
3
1
21a
21b
21
43c
14b
43d
432b
20
43
22
4
432a
14a
13b
22b
22a
633
62
621
63
22d
15c
15b
431
22c
41c
632a
632
41e
41
41b
622a
622
41d
41a
612
612a
6

100

432b
1
22b
22d
621
431
62
20
22
13b
4
633
21
14b
21b
22c
61
611
B
13a
21d
21c
63
43
31a
432a
31a
321
22a
323
14a
32
B
631
21a
31
B
31a

REACTOR

CROSS-REFERENCE TO RELATED APPLICATION

This application is based upon and claims the benefit of priority from Japan Patent Application No. 2017-208155, filed on Oct. 27, 2017, the entire contents of which are incorporated herein by reference.

FIELD OF THE INVENTION

The present disclosure relates to a reactor.

BACKGROUND

A reactor is applied to various electrical apparatuses, and includes a reactor main body that includes a core and coils wound around the circumference of the core, and a casing that houses therein the reactor main body. According to such a reactor, magnetic fluxes generated when a current flows through the coil passes through the interior of the core.

However, magnetic fluxes that have no path to the interior of the core leak to the exterior, and leakage magnetic fluxes are produced. When the leakage magnetic fluxes spread around the reactor, apparatuses or components such as a sensor installed around the reactor are caused to malfunction. In order to address this technical problem, as disclosed in JP H11-354339 A, the entire reactor main body is covered by a shielding member to suppress the leakage magnetic fluxes.

However, when the entire reactor main body is covered by the shielding member, it is necessary to ensure the insulation distance between the reactor main body and the shielding member. That is, it is necessary to provide a wide gap between the reactor main body and the internal surface of the shielding member. Accordingly, the internal space of the reactor increases, and the external shape of the reactor defined by the external shape of the shielding member becomes large.

Moreover, when the reactor is actuated by flowing a current through the coil, heat is produced. However, when the reactor main body is covered by the shielding member, the heat is trapped inside the shielding member. This further advances the deterioration of the reactor main body.

SUMMARY OF THE INVENTION

The present disclosure has been made to address the aforementioned technical problems, and an objective is to provide a reactor which is downsized and achieves an excellent heat dissipation effect while suppressing leakage of magnetic fluxes to the exterior.

A reactor according to the present disclosure includes a reactor main body that includes a core and a coil attached to the core, a casing that houses therein the reactor main body and has a portion where an opening is formed, a terminal stage that supports the portion of a conductor electrically connected to the coil, and a shielding member that is integrally formed with the terminal stage and suppresses the leakage of magnetic fluxes from the reactor main body while maintaining the opening opened.

According to the present disclosure, the aforementioned technical problems are addressed, and a reactor which is downsized and achieves an excellent heat dissipation effect while suppressing leakage of magnetic fluxes to the exterior can be obtained.

DETAILED DESCRIPTION OF THE EMBODIMENTS

A reactor according to this embodiment will be described below with reference to the figures. In this specification, an X-axis direction in the figure will be defined as a widthwise direction or a short-side direction, a Y-axis direction will be defined as a long-side direction, and a Z-axis direction will be defined as a height direction. One side in the Z-axis direction will be defined as an "upper" side, while the other side will be defined as a "lower" side. In order to describe the structure of each member, the "lower" side will be also referred to as a "bottom". The "upper" and "lower" sides indicate the positional relation of each component of the reactor, and such indication is not intended to limit the positional relation and the direction when the reactor is installed to an installation object.

Structure

Figure 1:
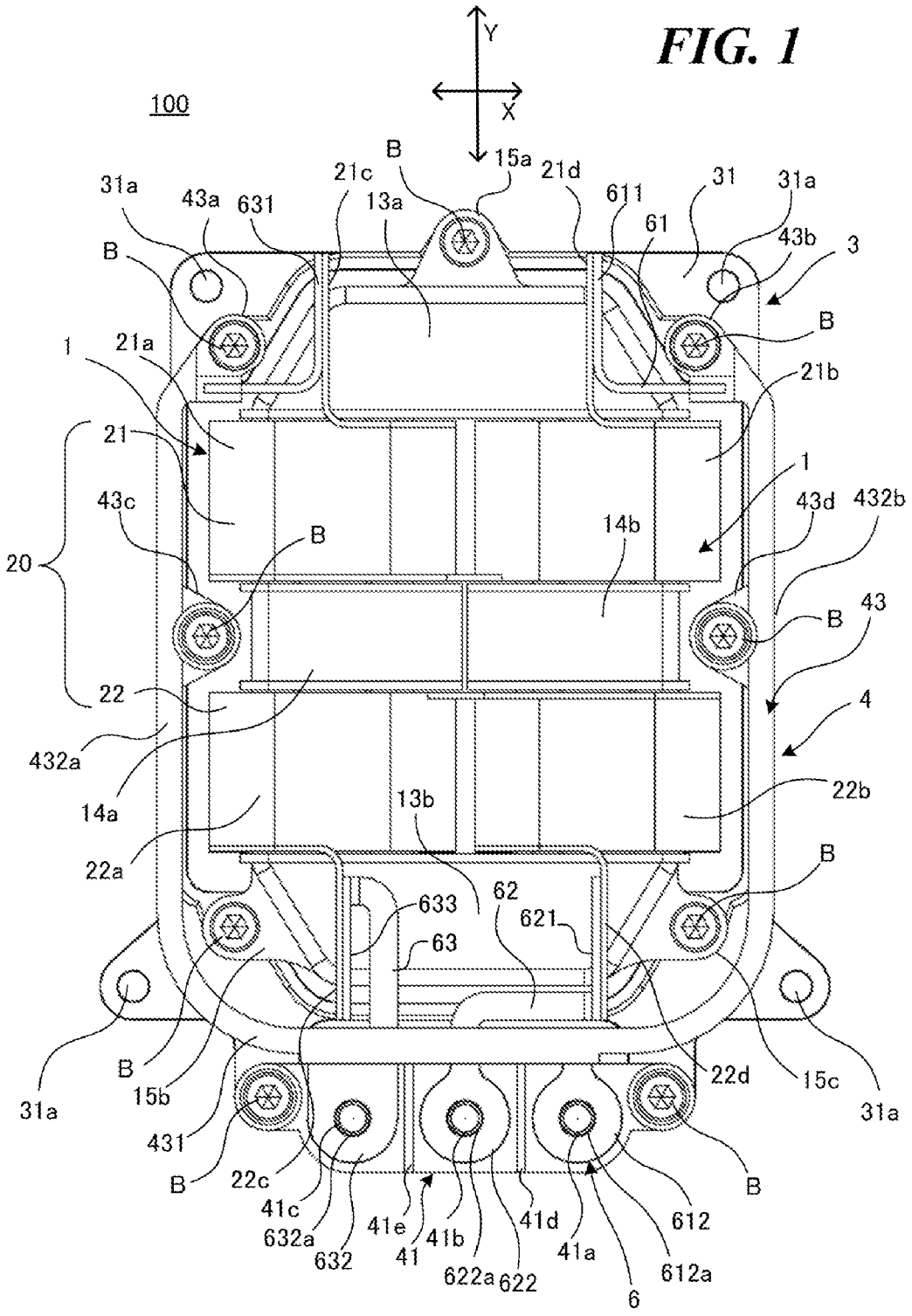
FIG. 1 is a plan view of a reactor according to an embodiment.
Figure 2:
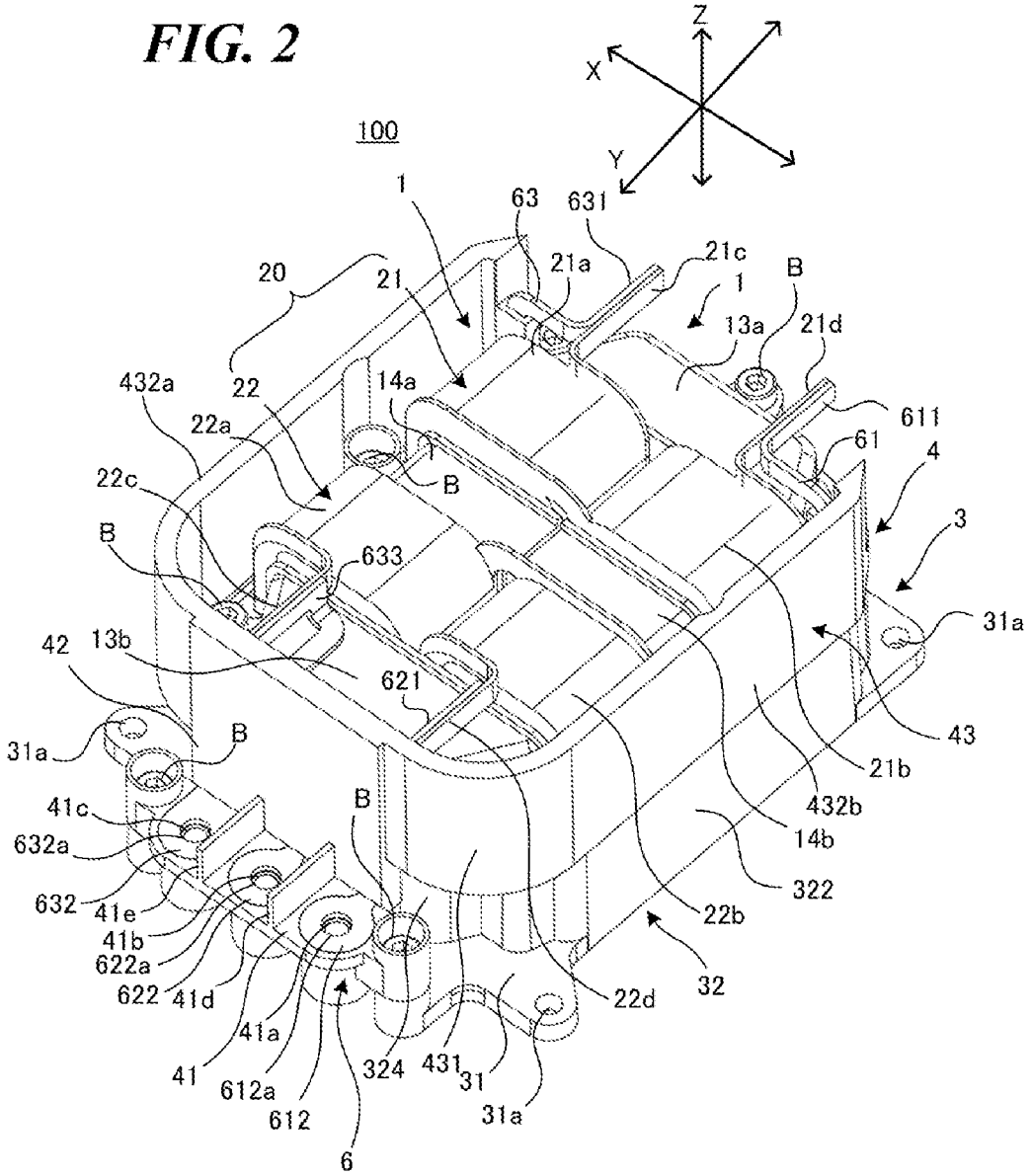
FIG. 2 is a front perspective view of the reactor according to the embodiment.
Figure 3:
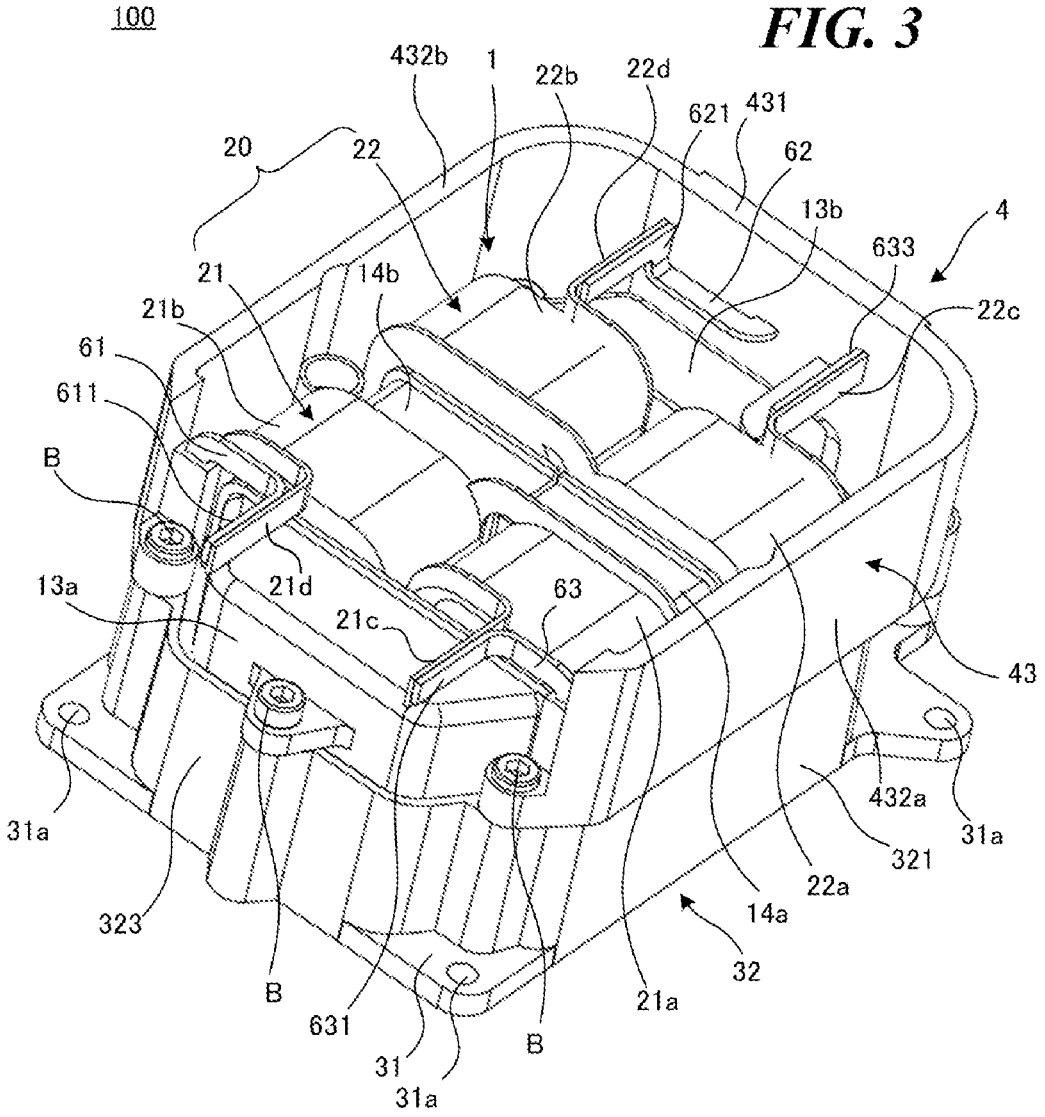
FIG. 3 is a rear perspective view of the reactor according to the embodiment.

As illustrated in FIG. 1 that is a plan view, FIG. 2 that is front perspective view, and FIG. 3 that is a rear perspective view, a reactor 100 includes a reactor main body 1, a casing 3, a terminal stage 4, a shielding member 5 (see FIG. 11), and a conductor 6.

Reactor Main Body

Figure 4:
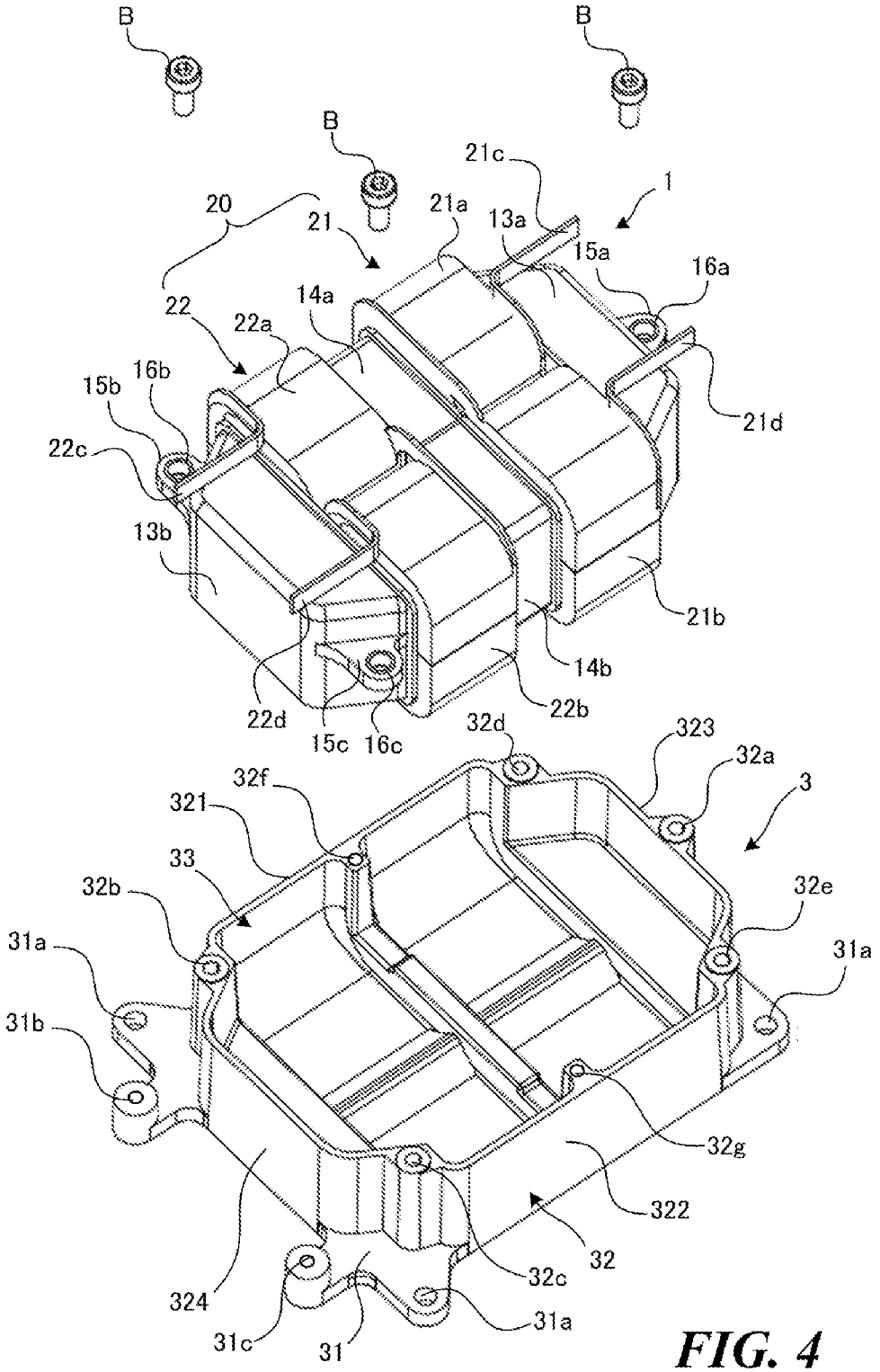
FIG. 4 is an exploded perspective view of a reactor main body and a casing.
Figure 5:
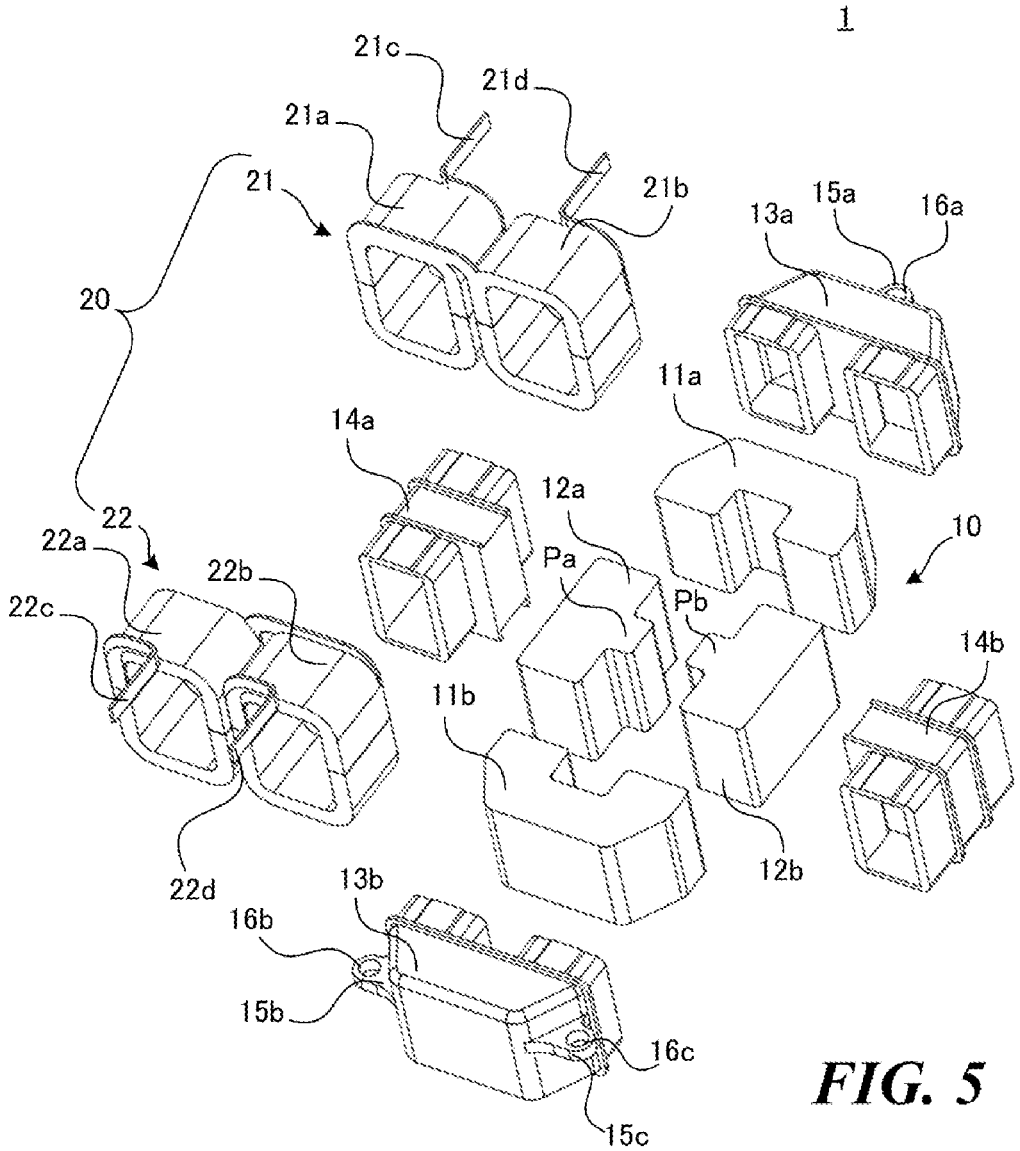
FIG. 5 is an exploded perspective view of the reactor main body.

As illustrated in FIG. 1 and FIG. 4 that is an exploded perspective view, the reactor main body 1 according to this embodiment is formed in a substantially rectangular shape with rounded corners as a whole in a plan view, and has a pair of long sides and a pair of short sides. The rectangular with rounded corners is a rectangle which has corners rounded. As illustrated in FIG. 5 that is an exploded perspective view, the reactor main body 1 includes a core 10 and a coil 20.

The core 10 is a magnetic body, such as a powder magnetic core, a ferrite magnetic core, or a laminated steel sheet, and has the interior serving as a path for magnetic fluxes generated by the coil 20 to be described later and forms a magnetic circuit. More specifically, the core 10 includes two U-shaped cores 11*a* and 11*b* and two T-shaped cores 12*a* and 12*b*. Center protrusions Pa and Pb are formed at opposing side surfaces of the T-shaped cores 12*a* and 12*b*. The core 10 is formed in a substantially θ shape as a whole by butting and joining both ends of the U-shaped cores 11*a* and 11*b*and respective both ends of the T-shaped cores 12*a* and 12*b* by an unillustrated adhesive.

Both ends of U-shaped cores 11*a* and 11*b* and respective both ends of T-shaped cores 12*a* and 12*b* may be butted to be directly in contact without applying an adhesive, or a magnetic gap may be provided therebetween. The magnetic gap may be formed by placing a spacer, or may be formed by a cavity.

The U-shaped cores 11*a* and 11*b* and the T-shaped cores 12*a* and 12*b* are housed in core casings 13*a*, 13*b*, 14*a*, and 14*b*, respectively. The core casings 13*a*, 13*b*, 14*a*, and 14*b* are each an insulation resin mold component for insulating the core 10 and the coil 20. The U-shaped cores 11*a* and 11*b* and the T-shaped cores 12*a* and 12*b* are formed integrally with the core casings 13*a*, 13*b*, 14*a*, and 14*b* by setting the cores in the respective molds, and filling a resin in a mold and curing the filled resin. That is, the U-shaped cores 11*a* and 11*b* and the T-shaped cores 12*a* and 12*b* are embedded in the respective materials of the core casings 13*a*, 13*b*, 14*a*, and 14*b*.

However, the core casings 13*a* and 13*b* that cover the U-shaped cores 11*a* and 11*b* have openings formed at portions corresponding to the joined surfaces between the U-shaped cores 11*a* and 11*b* and the T-shaped cores 12*a* and 12*b*. The core casing 14*a* and 14*b* that cover the T-shaped cores 12*a* and 12*b* have opening formed at portions corresponding to the joined surfaces between the T-shaped cores 12*a* and 12*b* and the U-shaped cores 11*a* and 11*b*. The openings of the core casings 13*a*, 13*b*, 14*a* and 14*b* are each provided with engaging portions to be engaged with each other when the core 10 is assembled in a substantially θ shape.

The end face of the center protrusion Pa of the T-shaped core 12*a* covered by the core casing 14*a* faces the end face of the center protrusion Pb of the T-shaped core 12*b* covered by the core casing 14*b* via a magnetic gap that is a cavity. This magnetic gap may be formed by a spacer, or may be formed by providing openings in the core casing 14*a* and 14*b* to expose the end faces of the center protrusions Pa and Pb when no magnetic gap is formed.

Attaching portions 15*a* and 15*b*, and, 15*c* for fastening to the casing 3 are formed on the respective external side surfaces of the core casing 13*a* and 13*b*. The attaching portions 15*a*, 15*b*, and 15*c* are each a tabular piece protruding outwardly, and attaching holes 16*a*, 16*b*, and 16*c* in which respective bolts B which are fastening members are inserted are formed. The attaching portion 15*a* is formed at the center of the U-shape of the core casing 13*a*, and the attaching portions 15*b* and 15*c* are formed at both shoulders of the U-shape of the core casing 13*b*. The attaching portions 15*a*, 15*b*, and 15*c* are formed simultaneously with the molding of the core casings 13*a* and 13*b*.

Coil

The coil 20 is a conductive member attached to the core 10. As illustrated in FIG. 5, the coil 20 according to this embodiment is an edgewise coil of a flat rectangular wire having an insulation cover. However, the material and the winding scheme of the coil 20 are not limited to any particular types, and other forms may be employed.

The coil 20 includes connection coils 21 and 22. The connection coil 21 forms a pair of partial coils 21*a* and 21*b* using a single conductor. The connection coil 22 forms a pair of partial coils 22*a* and 22*b* using a single conductor.

The partial coils 21*a* and 21*b* are attached to a pair of legs of the U-shaped core 11*a* and to one ends of the T-shaped cores 12*a* and 12*b* joined to such the legs. That is, the partial coils 21*a* and 21*b* are disposed at the U-shaped-core-11*a* side relative to the center protrusions Pa and Pb.

The partial coils 22*a* and 22*b* are attached to a pair of legs of the U-shaped core 11*b* and to other ends of the T-shaped cores 12*a* and 12*b* joined to such legs. That is, the partial coils 22*a* and 22*b* are disposed at the U-shaped-core-11*b* side relative to the center protrusions Pa and Pb.

Winding starting end and winding terminating end 21*c* and 21*d* of the connection coil 21 and winding starting end and winding terminating end 22*c* and 22*d* of the connection coil 22 are each drawn out to the exterior of the reactor main body 1. More specifically, the ends 21*c* and 21*d* extends along the long-side direction of the reactor main body 1, and protrude from the one short side. The ends 22*c* and 22*d* extends along the long-side direction of the reactor main body 1, and protrude from the other short side.

The connection coil 21 and the connection coil 22 are wound such that DC magnetic fluxes respectively generated are in directions opposing to each other. The wordings "wound such that DC magnetic fluxes are in the in directions opposing to each other" involve a case in which the winding direction is inverted and currents in the same direction are caused to flow, and a case in which the winding direction is consistent and currents in the opposite directions are caused to flow.

The reactor main body 1 is constructed by combining the above described core 10 and coils 20 as follows. That is, the U-shaped cores 11*a* and 11*b* and the T-shaped cores 12*a* and 12*b* embedded in the core casings 13*a*, 13*b*, 14*a*, and 14*b*, respectively, are inserted in the connection coils 21 and 22 which have been wound beforehand, and the joined surfaces of the U-shaped cores 11*a* and 11*b* and the T-shaped cores 12*a* and 12*b* are joined with each other by an adhesive. Next, the engaging portions of the core casings 13*a*, 13*b*, 14*a*, and 14*b* are engaged with each other.

Casing

As illustrated in FIG. 4 that is a perspective view, the casing 3 is a container which houses therein the reactor main body 1 and which has a portion where an opening 33 is formed. It is preferable that the casing 3 is formed of a material which has a high thermal conductivity and a magnetic shielding effect. For example, metals, such as aluminum, magnesium, or an alloy thereof, can be applied. Moreover, it is not necessary that the casing 3 is formed of a metal, and a resin which has an excellent thermal conductivity or a resin in which metal heat dissipation plates are partially embedded are also applicable. Furthermore, a magnetic body may be used for the entire casing 3 or a part of the casing 3. In comparison with a metal such as aluminum, the magnetic body has a higher magnetic shielding effect.

The casing 3 includes a support 31 and a wall 32. The support 31 is supported by an unillustrated installation surface. In this embodiment, the support 31 is a flat-plate member in a substantially rectangular shape. Concavities and convexities along the reactor main body 1 are formed in the surface of the support 31 at a side where the reactor main body 1 is housed. However, a clearance may be provided between the reactor main body 1 and the support 31.

Fastening holes 31*a* for fastening the support 31 to the installation surface are formed near the four corners of the support 31. Moreover, in order to attach the terminal stage 4 to be described later, a pair of attaching holes 31*b* and 31*c* is formed in the one short side of the support 31. The attaching holes 31*b* and 31*c* are provided at positions within the short side of the casing 3.

The wall 32 stands on the support 31, and surrounds the circumference of the reactor main body 1. The wall 32 has an opening 33 at the opposite side of the support 31. More specifically, the wall 32 includes a pair of side walls 321 and 322 in the long-side direction of the reactor main body 1, and a pair of side walls 323 and 324 in the short-side direction of the reactor main body 1. The space surrounded by the surfaces of the support 31 and the wall 32 facing the reactor main body 1 becomes a housing space for the reactor main body 1.

The opening 33 is an opened portion formed in the wall 32 at the opposite side of the support 31. In this embodiment, the upper portion of the casing 3 is opened by the opening 33, and a part of the reactor main body 1 is exposed from the casing 3 via the opening. That is, since the upper edge of the wall 32 is lower than the height of the core 10, when the reactor main body 1 is housed, the upper parts of the coil 20, the core casings 13*a*, 13*b*, 14*a*, and 14*b* are exposed via the opening 33.

Attaching holes 32*a*, 32*b*, and 32*c* are formed in the wall 32 at positions corresponding to the attaching holes 16*a*, 16*b*, and 16*c* of the core casings 13*a* and 13*b*. Screw grooves are formed in the attaching holes 32*a* and 32*b* and 32*c*. The reactor main body 1 is fastened to the casing 3 by aligning the attaching holes 16*a*, 16*b*, and 16*c* of the core casings 13*a* and 13*b* with the attaching holes 32*a*, 32*b*, and 32*c*, respectively, and inserting and turning bolts B. A clearance is formed between the reactor main body 1 and the support 31 of the casing 3 as described above.

Furthermore, attaching holes 32*d*, 32*e*, 32*f*, and 32*g* for the attachment of the terminal stage 4 are formed in the wall 32. In this embodiment, the attaching holes 32*d* and 32*e* are provided at both ends of the one side wall 323 parallel to the short-side direction, and the attaching holes 32*f* and 32*g* are provided near the centers of the pair of side walls 321 and 322 in the long-side direction, respectively. The attaching holes 32*f* and 32*g* are provided at protruding portions to enter a concaved space between the connection coil 21 of the reactor main body 1 and the connection coil 22 thereof. These attaching holes 32*d*, 32*e*, 32*f*, and 32*g* are formed inside the external shape of the casing 3. Moreover, screw grooves are formed in the attaching holes 32*d*, 32*e*, 32*f*, and 32*g*.

Filler may be filled and cured in the housing space of the casing 3 for the reactor main body 1. That is, a filler molded portion formed by a cured filler may be provided in the clearance between the casing 3 and the reactor main body 1. As for the filler, a resin which is relatively soft and which has a high thermal conductivity is suitable to ensure the heat dissipation performance of the reactor main body 1 and to reduce vibration transmission from the reactor main body 1 to the casing 3.

Terminal Stage

Figure 6:
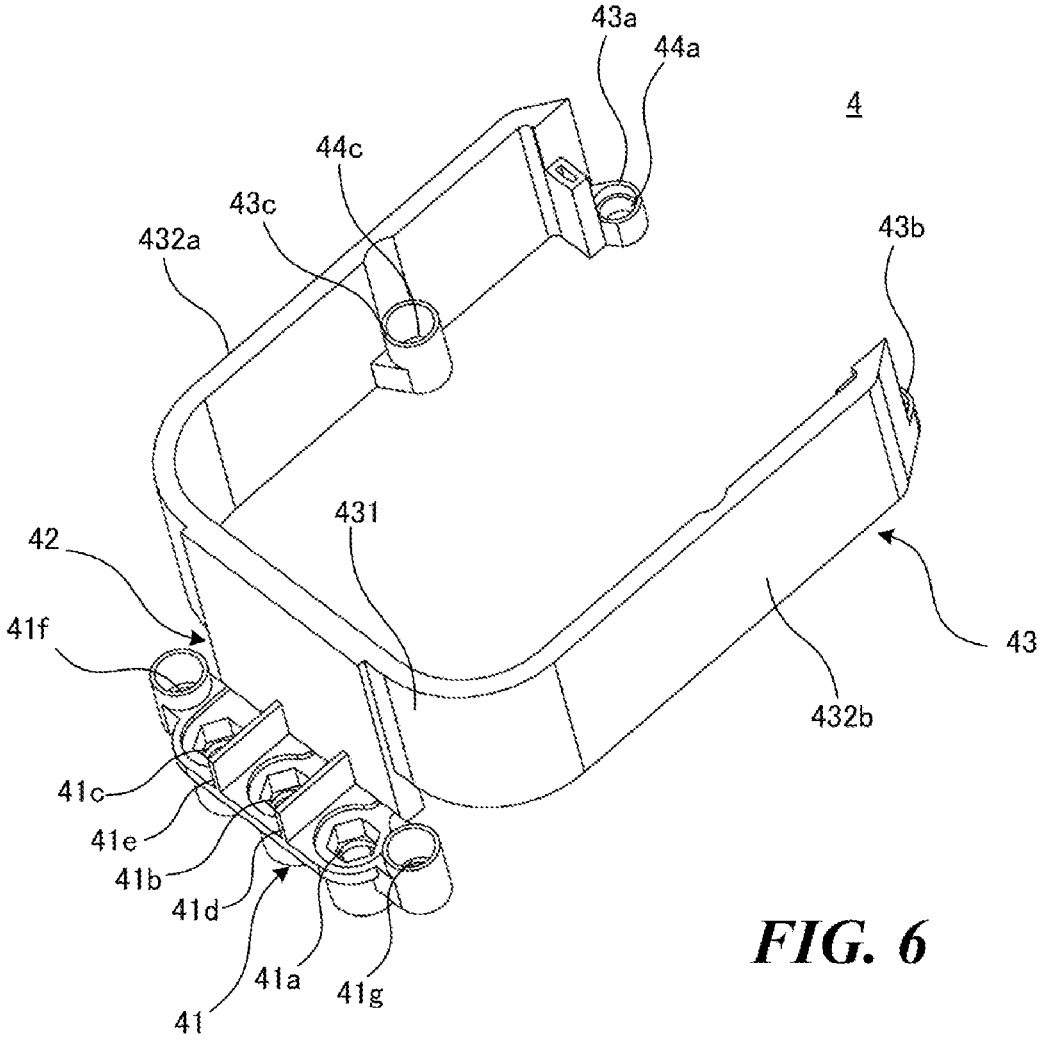
FIG. 6 is a perspective view of a terminal stage.

As illustrated in FIG. 1, the terminal stage 4 supports apart of the conductor 6 to be described later. The terminal stage 4 is entirely formed of a resin material. As illustrated in FIG. 6 that is a perspective view and FIG. 7 that is a plan view, the terminal stage 4 includes a stage portion 41, a connection portion 42, and a cover portion 43. The stage portion 41, the connection portion 42, and the cover portion 43 are formed integrally by a resin material. The wordings "formed integrally" involve a case in which the stage portion 41, the connection portion 42, and the cover portion 43 are separately formed and then integrated, and a case in which the stage portion 41, the connection portion 42, and the cover portion 43 are formed continuously without a seam.

The resin material that forms the terminal stage 4 is an insulation material. For example, polyphenylene sulfide (PPS), an unsaturated polyester-based resin, an urethane resin, an epoxy resin, bulk molding compound (BMP), polybutylene terephthalate (PBT), etc., are applicable as the resin material.

The stage portion 41 supports terminals 612, 622, and 632 (see FIG. 1) which are part of the conductor 6. The stage portion 41 is a tabular component parallel to the plane of the support 31. Three terminal holes 41*a*, 41*b*, and 41*c* arranged in the short-side direction are formed in the stage portion 41. Provided between each of the terminal holes 41*a*, 41*b*, and 41*c* are partitions 41*d* and 41*e* which protrude upwardly for insulation between each of the terminals 612 and 622 and 632.

Figure 8:
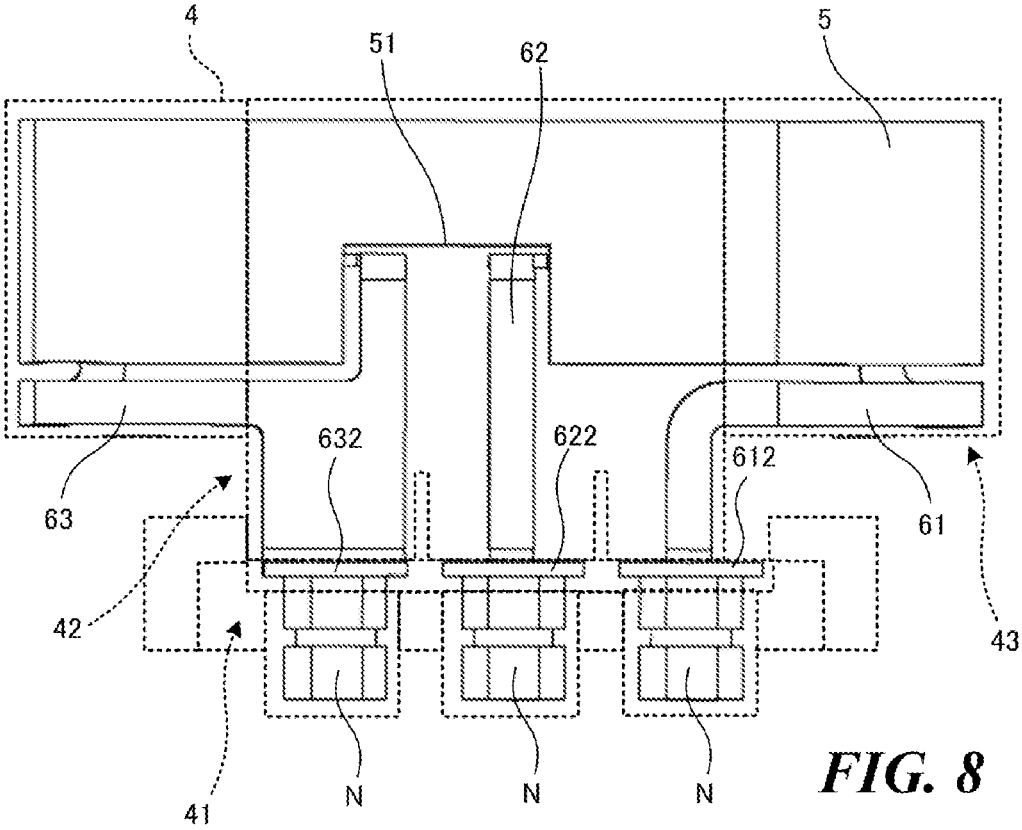
FIG. 8 is a transparent front view of the terminal stage.
Figure 9:
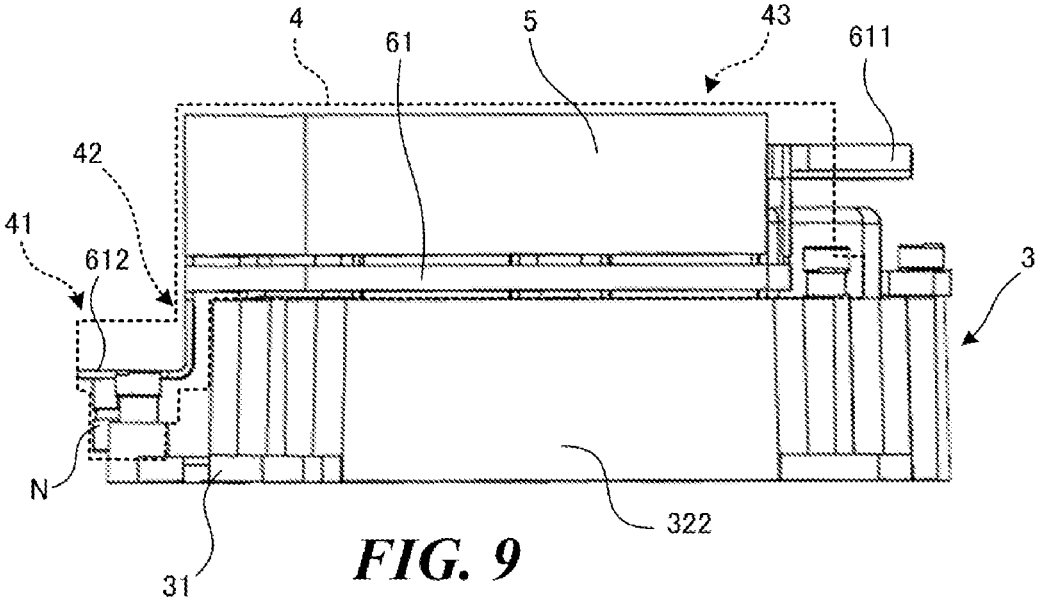
FIG. 9 is a transparent side view of the terminal stage.
Figure 10:
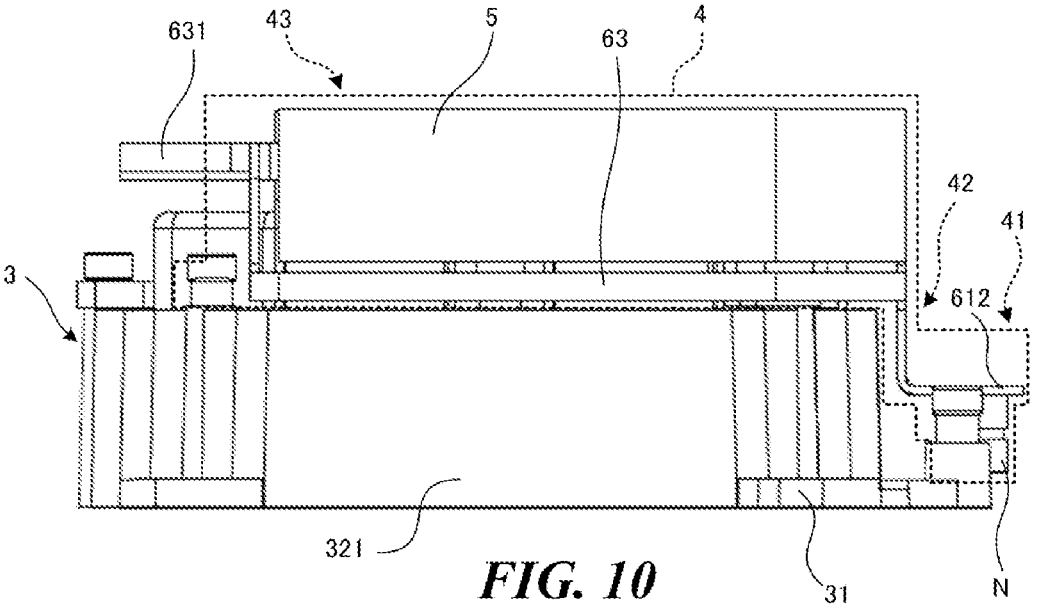
FIG. 10 is a transparent side view of the terminal stage.

Moreover, as illustrated in FIG. 8 that is a transparent front view, FIG. 9 that is a transparent right side view, and FIG. 10 that is a transparent left side view, nuts N are embedded in the lower portions of the terminal holes 41*a*, 41*b*, and 41*c* coaxially with the terminal holes 41*a*, 41*b*, and 41*c*, respectively. In FIGS. 8 to 10, the resin portion of the terminal stage 4 is indicated by dotted lines.

Furthermore, attaching holes 41*f* and 41*g* are provided in both ends of the stage portion 41 in the widthwise direction at positions corresponding to the attaching holes 31*b* and 31*c* of the casing 3. These attaching holes 41*f* and 41*g* are provided at posiotions within the length of the terminal stage 4 in the widthwise direction. The stage portion 41 is fastened to the casing 3 by aligning the attaching holes 41*f* and 41*g* with the attaching holes 31*b* and 31*c*, respectively, and inserting and turning bolts B.

The connection portion 42 is a tabular body in the height direction. The lower edge that is one end of the connection portion 42 is provided continuously from the stage portion 41, and the upper end that is the other end of the connection portion 42 is provided continuously from the cover portion 43. This connection portion 42 connects the stage portion 41 and the cover portion 43 which have different heights as will be described later.

The cover portion 43 is disposed at the side of the wall 32 opposite to the support 31 while maintaining the opening 33 of the casing 3 opened. The cover portion 43 according to this embodiment is a tabular component bent in a substantially U-shape. The center lower edge of the cover portion 43 in the short-side direction is continuous with the connection portion 42. The cover portion 43 is mounted on the wall 32 so that the stage portion 41 and the connection portion 42 side are aligned with the external surface of the one side wall 324 of the wall 32 (see FIG. 2).

The cover portion 43 extends from the side wall 324 at the one short side of the casing 3 to the side wall 323 at the other short side along the upper edges of the pair of side walls 321 and 322 and forms a substantially U-shape as a whole. In the following description, the connection portion between the cover portion 43 and the connection portion 42 will be referred to as a body 431, and the pair of portions along the side walls 321 and 322 will be referred to as arms 432*a* and 432*b*.

Figure 7:
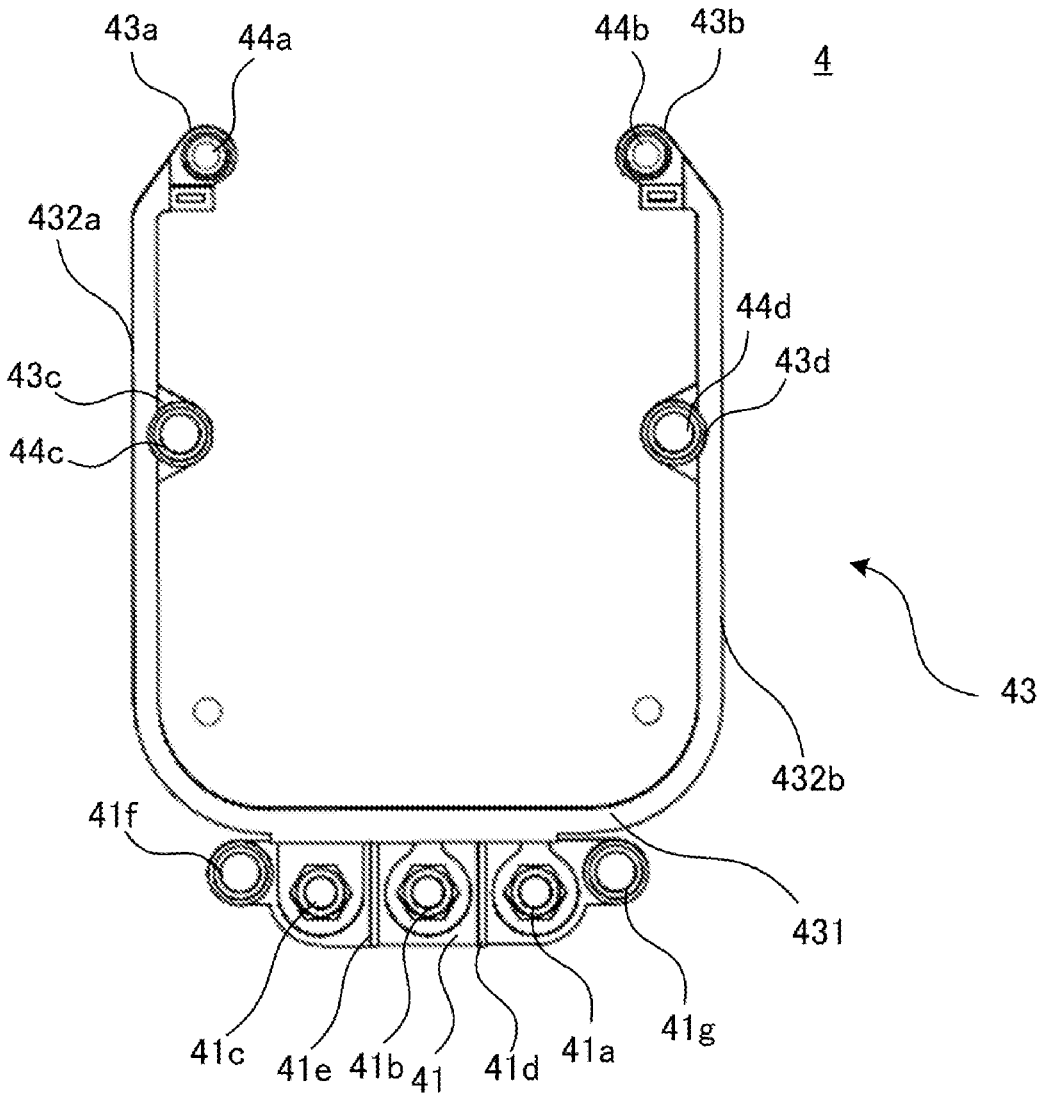
FIG. 7 is a plan view of the terminal stage.

As illustrated in FIG. 7, attaching portions 43*a* and 43*b* are formed at the respective ends of the arms 432*a* and 432*b* of the cover portion 43. Attaching portions 43*c* and 43*d* are formed near the respective centers of the arms 432*a* and 432*b* of the cover portion 43 in the lengthwise direction. These attaching portions 43*a*, 43*b*, 43*c*, and 43*d* are formed inside the terminal stage 4, that is, at the reactor-main-body-1 side of the cover portion 43. Attaching holes 44*a*, 44*b*, 44*c*, and 44*d* are formed in the respective attaching portions 43*a*, 43*b*, 43*c* and 43*d* at positions corresponding to the attaching holes 32*d*, 32*e*, 32*f*, and 32*g* of the casing 3, respectively. The cover portion 43 is fastened to the casing 3 by aligning the attaching holes 44*a*, 44*b*, 44*c*, and 44*d* with the attaching holes 32*d*, 32*e*, 32*f*, and 32*g* of the casing 3, respectively, and inserting and turning bolts B.

Such a cover portion 43 is mounted on the wall 32 so that the wall 32 is extended upwardly. Since the attaching portions 43*a*, 43*b*, 43*c*, and 43*d* are located inside the terminal stage 4 and do not protrude outwardly, the upper portion of the reactor 100 does not expand outwardly. Hence, since the upper opening 33 is kept opened even though the attaching portions 43*a*, 43*b*, 43*c*, and 43*d* are located inside the terminal stage 4, the upper portion of the reactor main body 1 is not closed, and the attachment by the bolts B is facilitated.

Shielding Member

Figure 11:
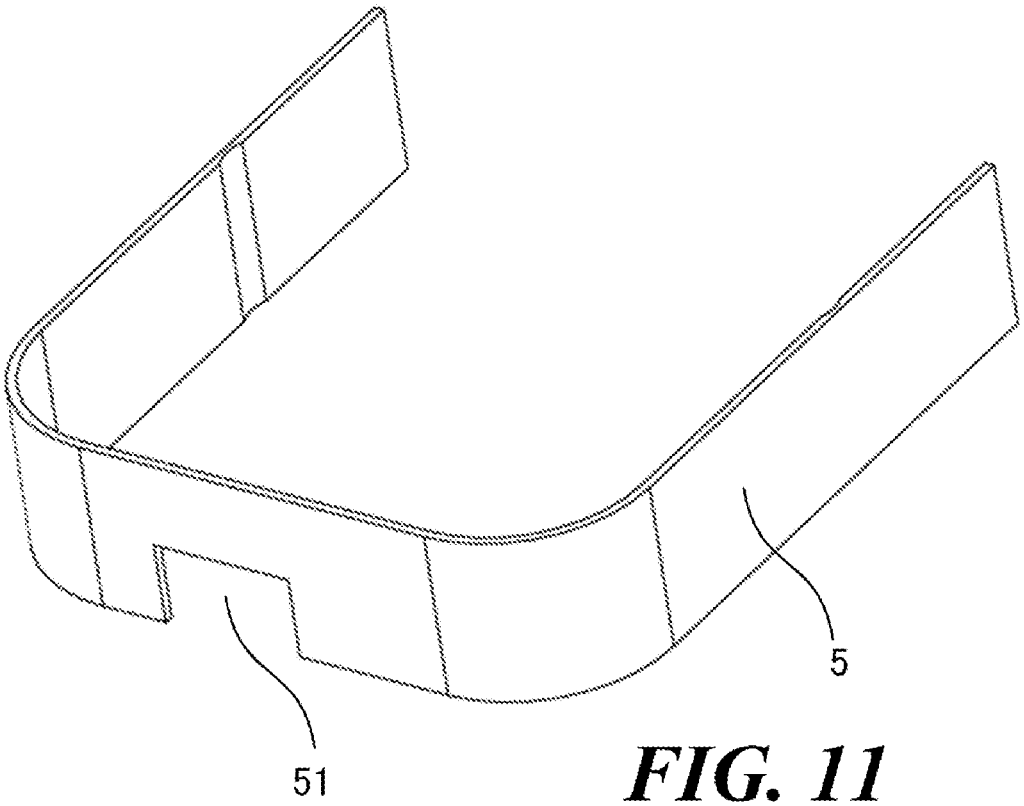
FIG. 11 is a perspective view of a shielding member.

As illustrated in FIGS. 8 to 10, the shielding member 5 is integrally formed with the terminal stage 4, and is a member that suppresses the leakage of the magnetic fluxes from the reactor main body 1 while maintaining the opening 33 opened. The wordings "integrally formed" involve a case in which the terminal stage 4 and the shielding member 5 are separately formed and integrated. The shielding member 5 is a tabular component formed of a material that has a shielding effect. As illustrated in FIG. 11 that is a perspective view, the shielding member 5 according to this embodiment is formed by bending a bandlike plate in a substantially U-shape. The material applied to the shielding member 5 is, for example, aluminum, magnesium, or an alloy thereof.

The shielding member 5 according to this embodiment is sealed together with the terminal stage 4 by a resin material. That is, the shielding member 5 is embedded in the resin material that forms the terminal stage 4. Hence, the wordings "integrally formed" also involves a case in which the terminal stage 4 and the shielding member 5 are continuously formed without a seam. More specifically, the shielding member 5 is embedded so as to be entirely covered by the substantially U-shape of the cover portion 43. Moreover, a notch 51 in which the conductor 6 to be described later is inserted is formed at the portion of the shielding member 5 corresponding to the body 431 of the cover portion 43. In this embodiment, the wordings "embedded in a resin material" involves a case in which a part of the embedded member is exposed at where there is no resin material. There may be cases in which no resin material is present at where a part of a mold contacts the member to be embedded for positioning. For example, when the resin material is supplied in the interior or the mold to form the terminal stage 4 and the shielding member 5 and a part of conductor 6 to be described later are embedded in the resin material, the part where the mold contacts to hold the shielding member 5 and the conductor 6 at positions that ensures an insulation distance becomes as an opening where there is no resin material.

As for the shielding member 5, a magnetic body with a shielding effect higher than a metal such as aluminum is also applicable. The magnetic body includes a magnetic material, and has a magnetic resistance lower than those of air and metals. The magnetic body is a ferromagnetic body and can be formed of the same material as that of the core 10. For example, the magnetic body may be formed of a mixed material of pure iron and sendust. Moreover, it is not necessary to form the entire shielding member 5 continuously, and the shielding member 5 may be formed by combining a plurality of plates.

The shielding member 5 according to this embodiment can shield the leakage of the magnetic fluxes from the one short side of the reactor main body 1 and the pair of long sides thereof. Hence, an adverse effect of the leakage magnetic fluxes to the external devices located at the one short side and at the pair of long sides is suppressed. In particular, since there is the terminal stage 4 at the one short side, the adverse effect of the leakage magnetic fluxes to the connected device near the terminal stage 4 is suppressed.

The cover portion 43 is provided at the high position of the casing 3 at the opening-33 side to shield the leakage magnetic fluxes from the opening 33 by the shielding member 5 embedded as described above. In contrast, the stage portion 41 is provided at the low position displaced at a side opposite to the opening 33 in the height direction to lower the height thereof to not interfere with the surrounding.

Conductor

Figure 12:
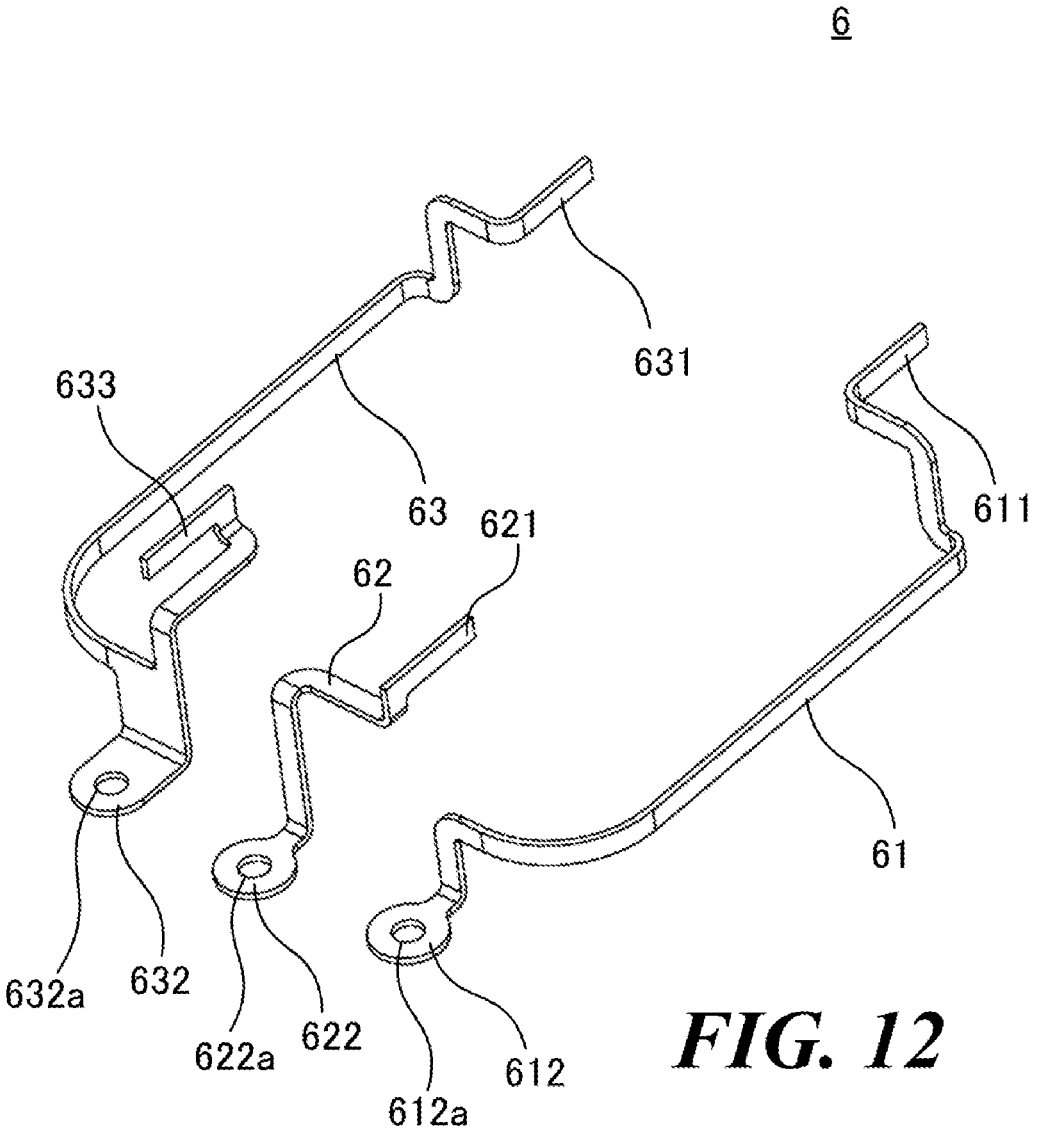
FIG. 12 is a perspective view of a conductor.

The conductor 6 is a conductive member for connecting the coil 20 to an unillustrated external device such as an external power supply. As illustrated in FIG. 12, the conductor 6 includes bus bars 61, 62, and 63. The bus bars 61, 62, and 63 are electrically connected to the coil 20, and are at least partially formed integrally with the terminal stage 4 together with the shielding member 5. That is, respective portions of the bus bars 61, 62, and 63 are embedded in the resin material of the terminal stage 4. The bus bars 61, 62, and 63 are each a thin bandlike member. Example materials applicable for the bus bars 61, 62, and 63 are copper, aluminum, etc.

As illustrated in FIGS. 1 to 3, one end of the bus bar 61 is a connection portion 611 connected by welding, etc., to the end 21*d* of the connection coil 21 where an insulation coating is peeled off. The other end of the bus bar 61 is a terminal 612 for a connection to the external device. A terminal hole 612*a* corresponding to the terminal hole 41*c* of the stage portion 41 is formed in the terminal 612.

A part of the bus bar 61 is embedded in the resin material that forms the terminal stage 4. Hence, the part of the portion from the connection portion 611 of the bus bar 61 to the terminal 612 is embedded in the cover portion 43 of the terminal stage 4 and in the connection portion 42 thereof. As illustrated in FIG. 9, the part of the bus bar 61 embedded in the cover portion 43 is disposed along the shielding member 5 at the casing-3 side. In this embodiment, the part of the bus bar 61 is provided along the area between the shielding member 5 and the casing 3 with an insulation distance ensured.

One end of the bus bar 62 is a connection portion 621 connected by welding etc., to the end 22*d* of the connection coil 22 where the insulation coating is peeled off. The other end of the bus bar 62 is a terminal 622 for a connection to the external device. A terminal hole 622*a* corresponding to the terminal hole 41*b* of the stage portion 41 is formed in the terminal 622.

A part of the bus bar 62 is embedded in the resin material that forms the terminal stage 4. Hence, the part of the portion from the connection portion 621 of the bus bar 62 to the terminal 622 is embedded in the cover portion 43 of the terminal stage 4 and in the connection portion 42 thereof. As illustrated in FIG. 8, the part of the bus bar 61 embedded in the cover portion 43 is inserted in the notch 51 of the shielding member 5.

One end of the bus bar 63 is a connection portion 631 connected by welding, etc., to the end 21*c* of the connection coil 21 where the insulation coating is peeled off. The other end of the bus bar 63 is branched into two ends. One branched end is a terminal 632 for a connection to the external device. A terminal hole 632*a* corresponding to the terminal hole 41*a* of the stage portion 41 is formed in the terminal 632. The other branched end is a connection portion 633 connected by welding, etc., to the end 22*c* of the connection coil 22 where the insulation coating is peeled off. Hence, the terminal 632 forms a common input terminal for the connection coils 21 and 22.

A part of the bus bar 63 is embedded in the resin material that forms the terminal stage 4. Hence, the part of the portion from the connection portion 631 of the bus bar 63 to the terminal 632 and the connection portion 633 is embedded in the cover portion 43 of the terminal stage 4 and the connection portion 42 thereof. As illustrated in FIG. 10, the part of the bus bar 63 embedded in the cover portion 43 is disposed along the shielding member 5 at the casing-3 side. In this embodiment, the part of the bus bar 63 is provided along the area between the shielding member 5 and the casing 3 with an insulation distance ensured.

Action and Effect (1) The reactor 100 according to this embodiment includes the reactor main body 1 that includes the core 10 and the coil 20 attached to the core 10, the casing 3 which houses therein the reactor main body 1 and has a portion where the opening 33 is formed, the terminal stage 4 that supports the portion of the conductor 6 electrically connected to the coil 20, and the shielding member 5 which is integrally formed with the terminal stage 4 and suppresses the leakage of magnetic fluxes from the reactor main body 1 while maintaining the opening 33 opened.

Hence, the shielding member 5 that suppresses the leakage of the magnetic fluxes from the reactor main body 1 maintains the opening 33 opened without covering the reactor main body 1. Hence, it is unnecessary to ensure the insulation distance between the shielding member 5 and the reactor main body 1 at the opening-33 side, and thus external shape of the reactor 100 can be made compact.

Figure 13:
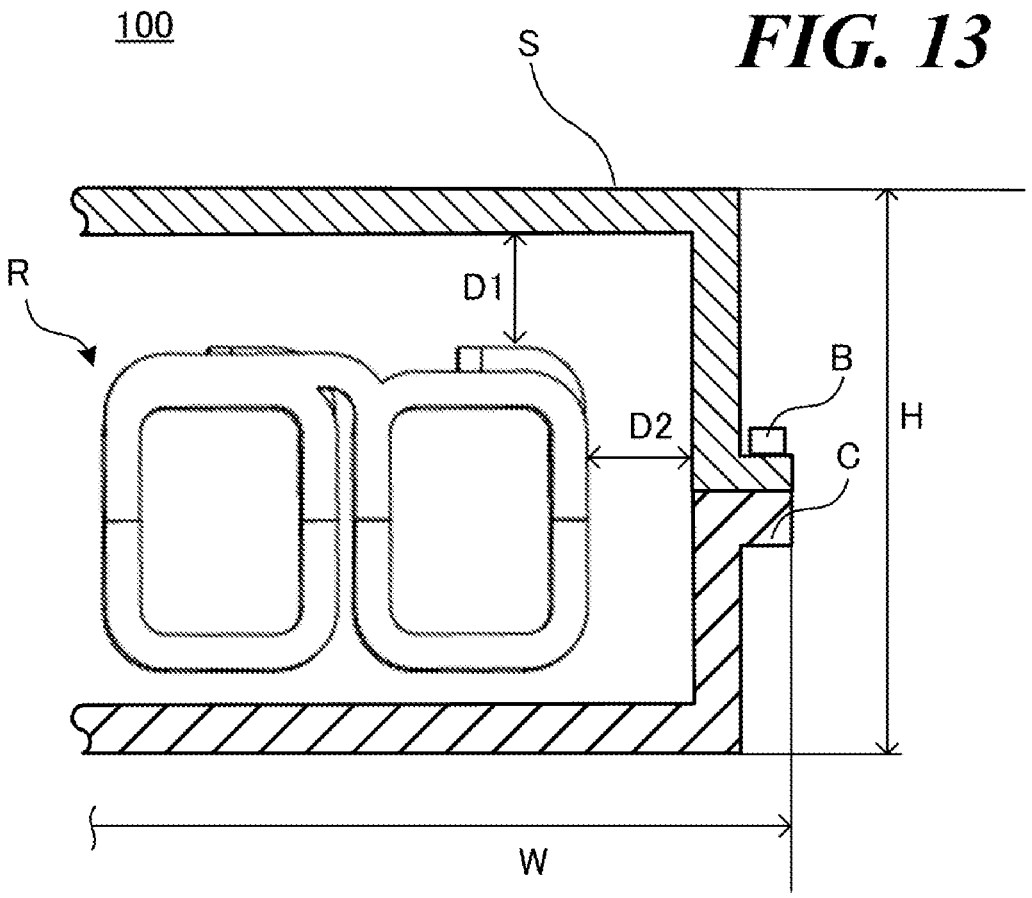
FIG. 13 is an explanatory diagram illustrating an example shielding member that covers the entire reactor main body.

For example, as illustrated in FIG. 13 that is a cross-sectional view, when a shielding member S is attached to a casing C to cover a reactor main body R, it is necessary to ensure an insulation distance D1 between the ceiling of the shielding member S and the reactor main body R, and since the thickness of the shielding member S is required, a height H, that is, the thickness of the reactor 100 increases. Accordingly, there is a possibility that the reactor cannot be installed when there is a restriction in the installation space in the height direction. In contrast, the reactor 100 according to this embodiment does not need to consider the insulation distance at the opening-33 side, and the thickness of the shielding member S becomes unnecessary. This enables an installation even if the installation space is narrow in the height direction.

Moreover, since the opening 33 is maintained opened, heat from the reactor main body 1 does not be trapped in the casing 3, and a deterioration due to overheating can be prevented. Furthermore, since the shielding member 5 is formed integrally with the terminal stage 4, the number of assembling steps can be reduced in comparison with a case in which the shielding member 5 is separately attached to the terminal stage 4 and the casing 3. Although vibration of the reactor main body 1 is individually transmitted the terminal stage 4 and the shielding member 5 when the terminal stage 4 and the shielding member 5 are different components, since the terminal stage 4 and the shielding member 5 according to this embodiment are integrated with each other, the adverse effect of vibration can be suppressed.

(2) The terminal stage 4 may be formed of a resin material, and the shielding member 5 may be embedded in the resin material that forms the terminal stage 4. Accordingly, the insulation between the shielding member 5, and the reactor main body 1 and the casing 3 can be easily ensured when the terminal stage 4 is attached to the casing 3.

(3) The conductor 6 may include the bus bars 61, 62 and 63 which are electrically connected to the coil 20 and are at least partially embedded in the resin material. This enables attachment of the bus bars 61, 62, and 63 together with the terminal stage 4, and the number of assembling steps can be further reduced. Moreover, since the positions of the bus bars 61, 62, and 63 are stabilized, displacement due to vibration is prevented, maintaining the insulation.

For example, in the example illustrated in FIG. 13, when the bus bar is disposed between the reactor main body R and the shielding member S, a work for separately disposing the bus bar to the shielding member S and the terminal stage 4 is necessary. In addition, it is also necessary to further increase the insulation distance D1 or D2 to ensure the insulation between the bus bar, and the reactor main body R and the shielding member S. In contrast, according to the reactor 100 of this embodiment, since the bus bars 61, 62, and 63 are integrated with the terminal stage 4 and the shielding member 5, it is unnecessary to consider the insulation distance, and an increase in size is suppressed and the assembling is facilitated.

(4) Parts of the bus bars 61, 62, and 63 may be disposed along the shielding member 5 at the casing-3 side. Accordingly, a dead space of the shielding member 5 at the casing-3 side can be effectively used, and an increase in size of the entire reactor 100 can be suppressed.

(5) The shielding member 5 may be provided in the casing 3 at the opening-33 side, the terminal stage 4 may include the stage portion 41 that supports the terminals 612, 622, and 632 at respective one ends of the bus bars 61, 62, and 63, and the stage portion 41 may be provided at a position displaced to the side opposite to the opening 33 of the casing 3 in the height direction. This prevents the circumference around the reactor 100 at the opening-33 side of the casing 3 from being enlarged by the stage portion 41, and an interference with other devices can be suppressed.

(6) The terminal stage 4 may include the attaching portions 43*a*, 43*b*, 43*c*, and 43*d* to the casing 3 at the reactor-main-body 1 side. This prevents the reactor 100 from protruding outwardly at the attached portion. For example, as illustrated in FIG. 13, when the reactor main body R is covered by the shielding member S, the number of locations where the attaching portions protrude by the bolts B increases. In contrast, according to this embodiment, since the reactor main body 1 is not covered, even if the reactor main body 1 has the attaching portions 43*a*, 43*b*, 43*c*, and 43*d*, the attachment work is enabled.

(7) The shielding member 5 may be formed of the material containing aluminum. This facilitates the shielding member 5 to be formed in a desired shape. For example, as described above, even if the shielding member 5 has a bent portion, the shielding member can be easily formed as a continuous single body, and a work of embedding in the resin material can be facilitated.

(8) The shielding member 5 may be formed of the material containing a magnetic body. This improves the shielding effect to the leakage of the magnetic fluxes.

Other Embodiments

The present disclosure is not limited to the above described embodiment, and includes other embodiments to be described below. The present disclosure also includes a combination of all or some of the above described embodiment and the following other embodiments. Various omissions, replacements, and modifications can be made without departing from the scope of the present disclosure, and such forms is also within the scope of the present disclosure.

Figure 14:
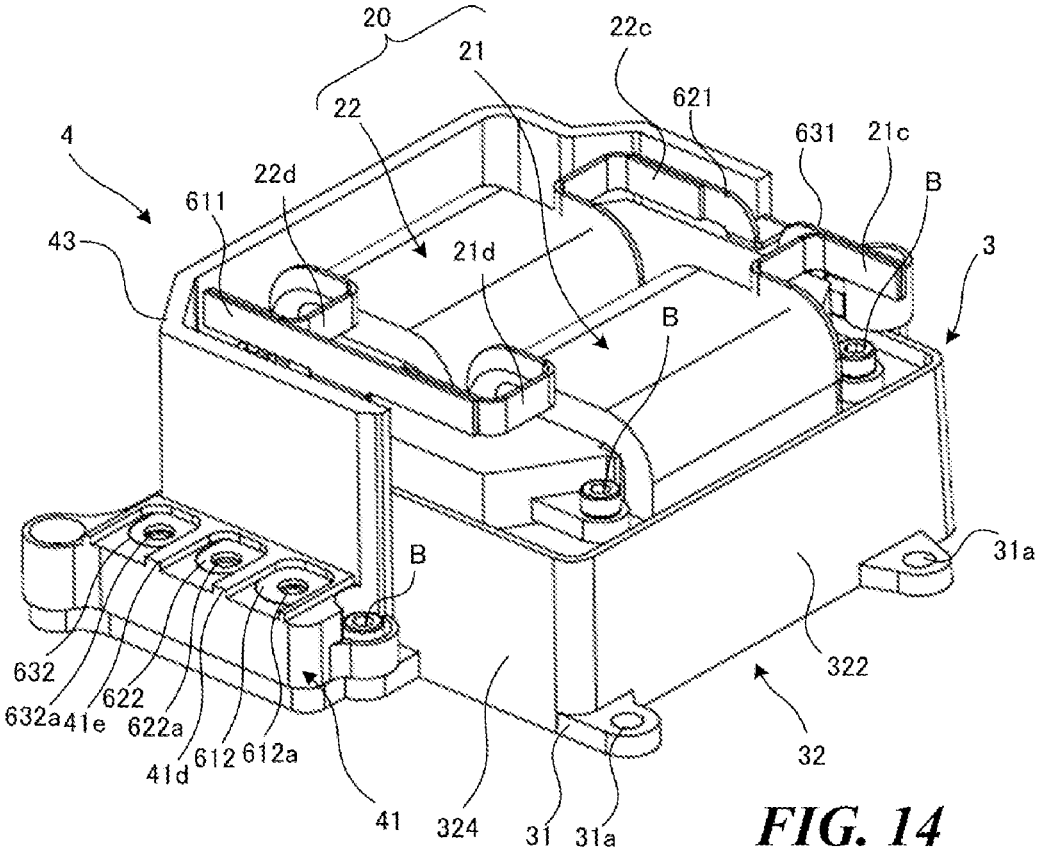
FIG. 14 is a front perspective view of a reactor according to a modified example of the embodiment.

(1) The direction in which the leakage of the magnetic fluxes is suppressed by the shielding member 5 is not limited to the above described case. It is appropriate if the shielding member 5 is disposed at any of the surroundings of the reactor main body 1 and suppresses the leakage of the magnetic fluxes. The shielding member 5 may be disposed at either one side, two sides, or three sides among the four sides, or may be disposed at all four sides. The shielding member may be disposed at the adjacent two sides, or the opposing two sides. The shielding member 5 may be disposed to partially shield one side. For example, as illustrated in FIG. 14 that is a front perspective view, FIG. 15 that is a side view, and FIG. 16 that is a rear view, the shielding member 5 may be disposed across a portion at opposing two sides and one side therebetween.

Figure 15:
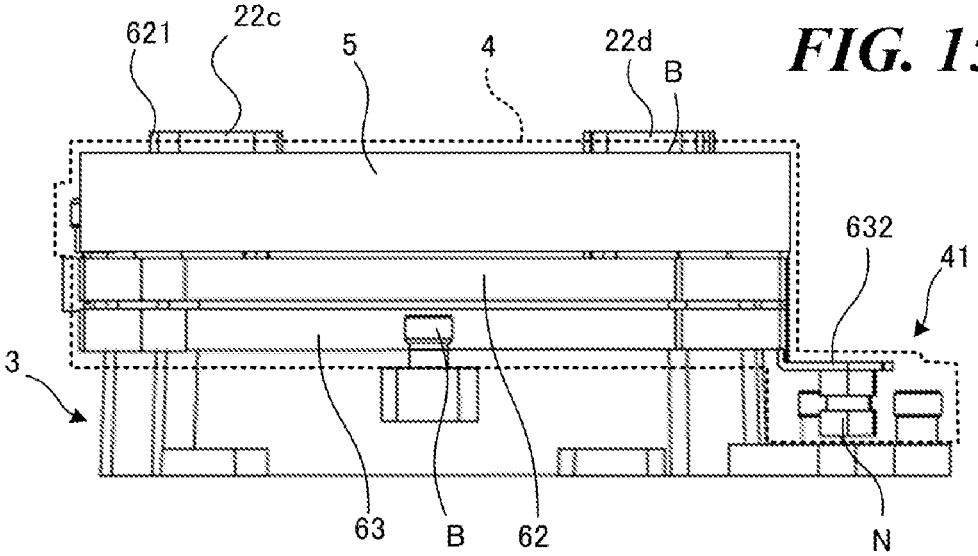
FIG. 15 is a side view of FIG. 14.
Figure 16:
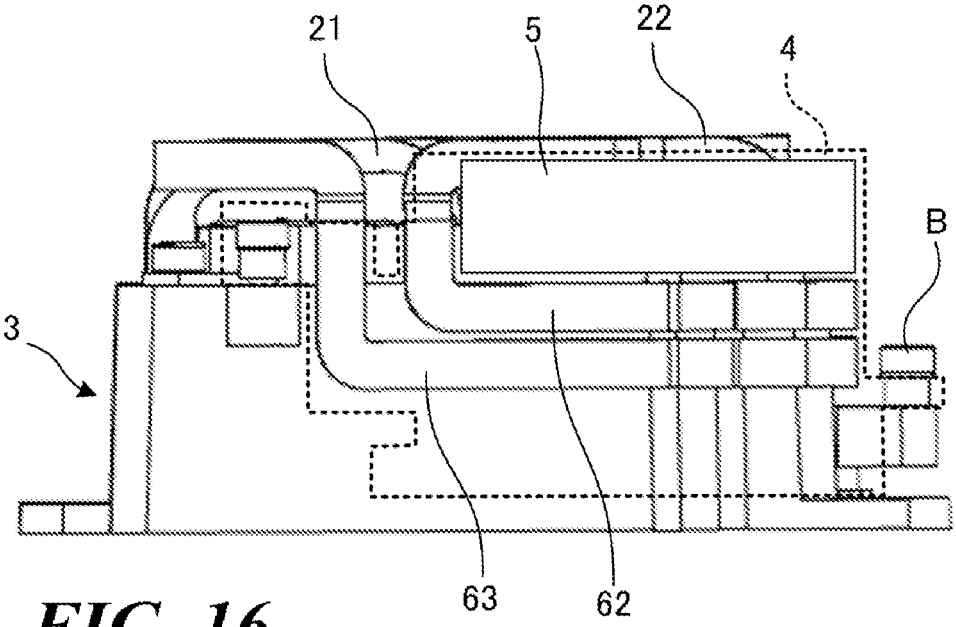
FIG. 16 is a rear view of FIG. 14.

(2) The shape, number, etc., of the core 10 of the reactor main body 1, and those of the coil 20 thereof are not limited to the above embodiment. The core 10 may be a combination of a pair of C-shaped cores, a combination of a C-shaped core with an I-shaped core, a combination of four I-shaped cores, etc. Regarding the structure of the core 20, as illustrated in FIGS. 14 to 16, the pair of coils 21 and 22 that employ a simple winding scheme may be applied instead of the winding scheme of the partial coils 21*a*, 21*b*, 22*a* and 22*b*. For example, the core 10 may be a combination of a pair of C-shaped cores, and the coil 20 may be formed by the pair of connection coils 21 and 22.

(3) The position, number, etc., of the conductor 6 is not limited to the above described embodiment. For example, as illustrated in FIGS. 14 to 16, the bus bar 62 and 63 may be disposed at a position along a side surface of the casing 3 a lower edge of the shielding member 5 and which. This further reduces the height of the reactor 100. In the example illustrated in FIGS. 14 to 16, the connection portion 42 between the stage portion 41 and the cover portion 43 is omitted because the height of the reactor 100 is reduced.

What is claimed is:

1. A reactor comprising:

a reactor main body that comprises a core and a coil attached to the core;

a casing that houses therein the reactor main body and has a portion where an opening is formed;

a terminal stage that supports a portion of a conductor electrically connected to the coil; and a shielding member that is integrally formed with the terminal stage and suppresses a leakage of magnetic fluxes from the reactor main body while maintaining the opening opened, wherein the terminal stage is formed of a resin material, and wherein the shielding member is embedded in the resin material that forms the terminal stage, and provided in the casing at the opening side.

2. The reactor according to claim 1, wherein the conductor comprises a bus bar which is electrically connected to the coil and which is at least partially embedded in the resin material.

3. The reactor according to claim 2, wherein a part of the bus bar is disposed along the shielding member at the casing side.

4. The reactor according to claim 2, wherein:

the terminal stage comprises a stage portion which supports a terminal of the bus bar at one end; and the stage portion is provided at a position displaced to a side opposite to the opening of the casing in a height direction.

5. The reactor according to claim 1, wherein the terminal stage comprises an attaching portion to the casing at the reactor-main-body side.

6. The reactor according to claim 1 wherein the shielding member is formed of the material containing aluminum.

7. The reactor according to claim 1, wherein the shielding member is formed of the material containing a magnetic body.

8. A reactor comprising:

a reactor main body that comprises a core and a coil attached to the core;

a casing that houses therein the reactor main body and has a portion where an opening is formed;

a terminal stage that supports a portion of a conductor electrically connected to the coil; and a shielding member that is integrally formed with the terminal stage and suppresses a leakage of magnetic fluxes from the reactor main body while maintaining the opening opened, wherein the terminal stage is formed of a resin material;

the conductor comprises a bus bar which is electrically connected to the coil and which is at least partially embedded in the resin material;

a part of the bus bar is disposed along the shielding member at the casing side; and the shielding member is provided in the casing at the opening side.

9. The reactor according to claim 8, wherein the terminal stage comprises an attaching portion to the casing at the reactor-main-body side.

10. The reactor according to claim 8 wherein the shielding member is formed of the material containing aluminum.

11. The reactor according to claim 8, wherein the shielding member is formed of the material containing a magnetic body.

12. A reactor comprising:

a reactor main body that comprises a core and a coil attached to the core;

a casing that houses therein the reactor main body and has a portion where an opening is formed;

a terminal stage that supports a portion of a conductor electrically connected to the coil; and a shielding member that is integrally formed with the terminal stage and suppresses a leakage of magnetic fluxes from the reactor main body while maintaining the opening opened, wherein the terminal stage is formed of a resin material, the shielding member is embedded in the resin material that forms the terminal stage, the conductor comprises a bus bar which is electrically connected to the coil and which is at least partially embedded in the resin material, a part of the bus bar is disposed along the shielding member at the casing side, and the shielding member is provided in the casing at the opening side, the terminal stage comprises a stage portion which supports a terminal of the bus bar at one end, and the stage portion is provided at a position displaced to a side opposite to the opening of the casing in a height direction.

13. The reactor according to claim 12, wherein the terminal stage comprises an attaching portion to the casing at the reactor-main-body side.

14. The reactor according to claim 12 wherein the shielding member is formed of the material containing aluminum.

* * * * *